US007298260B1

(12) United States Patent
Cossette

(10) Patent No.: US 7,298,260 B1
(45) Date of Patent: Nov. 20, 2007

(54) TESLA COIL SECURITY SYSTEM

(76) Inventor: Harold J. Cossette, 117 Gem Hill Rd., Wallace, ID (US) 83873-9603

( * ) Notice: Subject to any disclaimer, the term of this patent is extended or adjusted under 35 U.S.C. 154(b) by 279 days.

(21) Appl. No.: 11/077,412

(22) Filed: Mar. 9, 2005

(51) Int. Cl.
*G08B 13/24* (2006.01)

(52) U.S. Cl. ..... 340/551; 340/573.1

(58) Field of Classification Search ..... 340/551, 340/552, 561, 564, 565, 541, 573.1
See application file for complete search history.

(56) References Cited

U.S. PATENT DOCUMENTS

| | | | | |
|---|---|---|---|---|
| 3,812,484 | A | 5/1974 | Miller et al. | 340/258 |
| 4,091,367 | A | 5/1978 | Harman | 340/258 |
| 4,763,937 | A | 8/1988 | Sittnick, Jr. et al. | 292/251.5 |
| 4,897,630 | A | 1/1990 | Nykerk | 340/426 |
| 4,987,402 | A | 1/1991 | Nykerk | 340/426 |
| 5,039,981 | A | 8/1991 | Rodriguez | 340/551 |
| 5,049,858 | A | 9/1991 | Price | 340/552 |
| 5,117,217 | A | 5/1992 | Nykerk | 340/426 |
| 5,241,923 | A * | 9/1993 | Janning | 119/721 |
| 5,311,166 | A * | 5/1994 | Frye | 340/541 |
| 5,315,285 | A | 5/1994 | Nykerk | 340/426 |
| 5,440,289 | A | 8/1995 | Riordan | 340/550 |
| 5,552,769 | A | 9/1996 | Riordan | 340/550 |
| 5,612,670 | A | 3/1997 | Snyder et al. | 340/429 |
| 5,781,108 | A * | 7/1998 | Jacob et al. | 340/552 |
| 5,883,574 | A | 3/1999 | Asbrink | 340/572 |
| 6,114,963 | A * | 9/2000 | Blake et al. | 340/573.4 |
| 6,304,178 | B1 | 10/2001 | Hayashida | 340/545.1 |
| 6,611,208 | B1 | 8/2003 | Ketler | 340/632 |
| 6,657,544 | B2 * | 12/2003 | Barry et al. | 340/573.3 |
| 6,724,316 | B2 | 4/2004 | Addy et al. | 340/686.1 |
| 2002/0154013 | A1 | 10/2002 | Touge | 340/553 |
| 2003/0173849 | A1 | 9/2003 | Marshall, Jr. | 310/156.01 |
| 2004/0119375 | A1 | 6/2004 | Ney et al. | 310/309 |

OTHER PUBLICATIONS www.teslacoil.net, Website Printout, Publication Date Unknown, 1 page, Feb. 22, 2005.

* cited by examiner

*Primary Examiner*—Phung T. Nguyen

(57) ABSTRACT

A tesla coil security system for proactively and effectively deterring unauthorized individuals from entering an opening in a non-lethal manner. The tesla coil security system includes a tesla coil, a length of wire electrically connected to the tesla coil for surrounding an opening to be protected, and a plurality of charge dissipaters electrically extending from the wire for facilitating the discharge of electrical charge thereby creating an electrical visual effect for deterring entry through the opening. A control unit is in communication with the tesla coil for controlling the operation of the tesla coil and a sensor is in communication with the control unit for determining the presence of an individual, whereby detection by the sensor of the presence of an individual causes the tesla coil to be activated.

20 Claims, 6 Drawing Sheets

TESLA COIL SECURITY SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to security systems and more specifically it relates to a tesla coil security system for proactively and effectively deterring unauthorized individuals from entering an opening in a non-lethal manner.

2. Description of the Related Art

Any discussion of the prior art throughout the specification should in no way be considered as an admission that such prior art is widely known or forms part of common general knowledge in the field.

Security systems have been in use for years (e.g. home security systems, vehicle security systems). A conventional security system is typically merely "reactive" in the sense that it is not activated until after an unauthorized entry has occurred through an opening (e.g. door, window). In other words, criminals and other unauthorized individuals are typically not deterred from entering or attempting to enter an opening in a building, vehicle and the like with conventional security systems. Common reactive responses from conventional security systems is an audible alarm (e.g. siren, warning voice), a visual alarm (e.g. flashing light), and/or an alarm signal transmitted to a security center or government authorities (e.g. police).

While conventional security systems may be suitable for the particular purpose to which they address, they are not as suitable for proactively and effectively deterring unauthorized individuals from entering an opening in a non-lethal manner. Conventional alarm systems are merely "reactive" to an unauthorized entry through an opening and are not typically "proactive" in deterring unauthorized entry into a location.

In these respects, the tesla coil security system according to the present invention substantially departs from the conventional concepts and designs of the prior art, and in so doing provides an apparatus primarily developed for the purpose of proactively and effectively deterring unauthorized individuals from entering an opening in a non-lethal manner.

BRIEF SUMMARY OF THE INVENTION

In view of the foregoing disadvantages inherent in the known types of security systems now present in the prior art, the present invention provides a new tesla coil security system construction wherein the same can be utilized for proactively and effectively deterring unauthorized individuals from entering an opening in a non-lethal manner.

The general purpose of the present invention, which will be described subsequently in greater detail, is to provide a new tesla coil security system that has many of the advantages of the security systems mentioned heretofore and many novel features that result in a new tesla coil security system which is not anticipated, rendered obvious, suggested, or even implied by any of the prior art security systems, either alone or in any combination thereof.

To attain this, the present invention generally comprises a tesla coil, a length of wire electrically connected to the tesla coil for surrounding an opening to be protected, and a plurality of charge dissipaters electrically extending from the wire for facilitating the discharge of electrical charge thereby creating an electrical visual effect for deterring entry through the opening. A control unit is in communication with the tesla coil for controlling the operation of the tesla coil and a sensor is in communication with the control unit for determining the presence of an individual, whereby detection by the sensor of the presence of an individual causes the tesla coil to be activated.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a tesla coil security system that will overcome the shortcomings of the prior art devices.

A second object is to provide a tesla coil security system for proactively and effectively deterring unauthorized individuals from entering an opening in a non-lethal manner.

Another object is to provide a tesla coil security system that does not utilize lethal force to deter unauthorized entry into a location.

An additional object is to provide a tesla coil security system that creates a visual effect surrounding an opening to be protected from unauthorized entry that deters unauthorized individuals from attempting to pass through the opening.

A further object is to provide a tesla coil security system that may be utilized about various types of openings such as but not limited to doors, windows, passages, hallways and the like.

Another object is to provide a tesla coil security system that may be utilized upon various objects and structures such as but not limited to buildings, homes, vehicles and the like.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
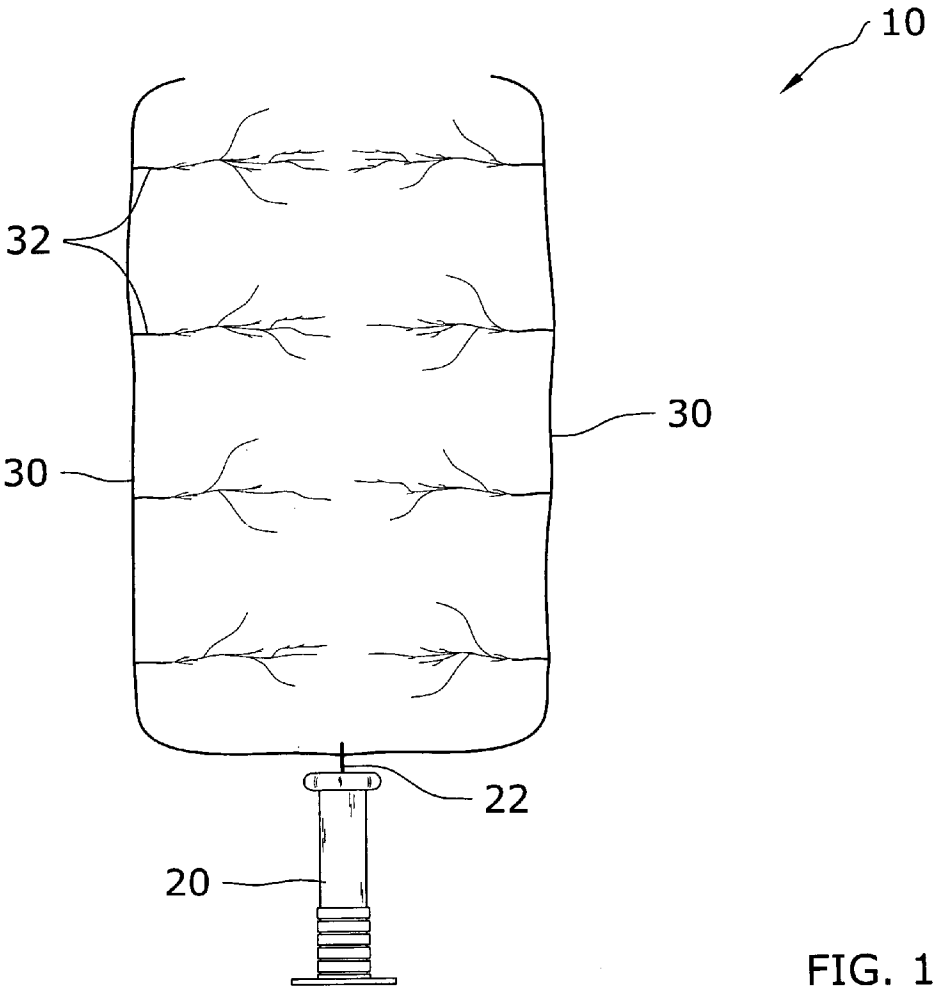
FIG. 1 is a front view of the present invention.

Turning now descriptively to the drawings, in which similar reference characters denote similar elements throughout the several views, FIGS. 1 through 6 illustrate a tesla coil security system 10, which comprises a tesla coil 20, a length of wire 30 electrically connected to the tesla coil 20 for surrounding an opening 12 to be protected, and a plurality of charge dissipaters 32 electrically extending from the wire 30 for facilitating the discharge of electrical charge thereby creating an electrical visual effect for deterring entry through the opening 12. A control unit 40 is in communication with the tesla coil 20 for controlling the operation of the tesla coil 20 and a sensor 50 is in communication with the control unit 40 for determining the presence of an individual, whereby detection by the sensor 50 of the presence of an individual causes the tesla coil 20 to be activated.

B. Tesla Coil

FIGS. 1 through 6 illustrate the usage of a tesla coil 20 to generate the electrical charge that is electrically transferred through the wire 30 and the charge dissipaters 32. The tesla coil 20 may be comprised of any conventional tesla coil 20 or any other device capable of generating a similar electrical charge.

C. Length of Wire

As shown in FIGS. 1 through 5 of the drawings, a length of wire 30 is electrically connected to an electrical connector 22 of the tesla coil 20. The length of wire 30 preferably substantially surrounds an opening 12 to be protected (e.g. a doorway, a window, a hallway or a passage of a building structure; doorway and/or window of a vehicle). The length of wire 30 may be comprised of various materials such as but not limited to copper.

As best illustrated in FIGS. 2 through 5 of the drawings, the length of wire 30 is preferably formed into a closed loop and/or an open loop structure about the perimeter of the opening 12 as shown in FIGS. 1 through 5 of the drawings. The loop may have various shapes capable of deterring unauthorized entry through the opening 12.

Figure 2:
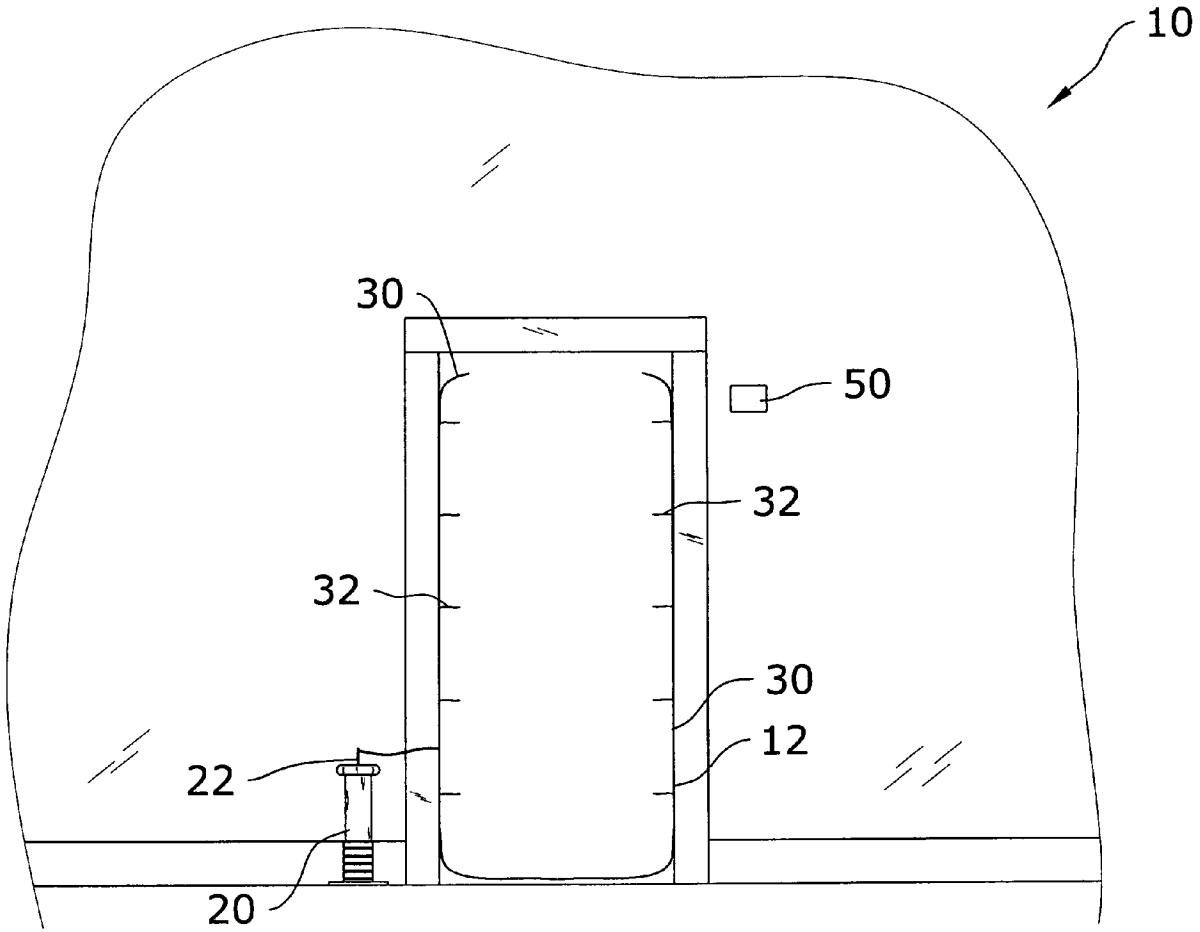
FIG. 2 is a front view of the present invention positioned within a doorway.
Figure 3:
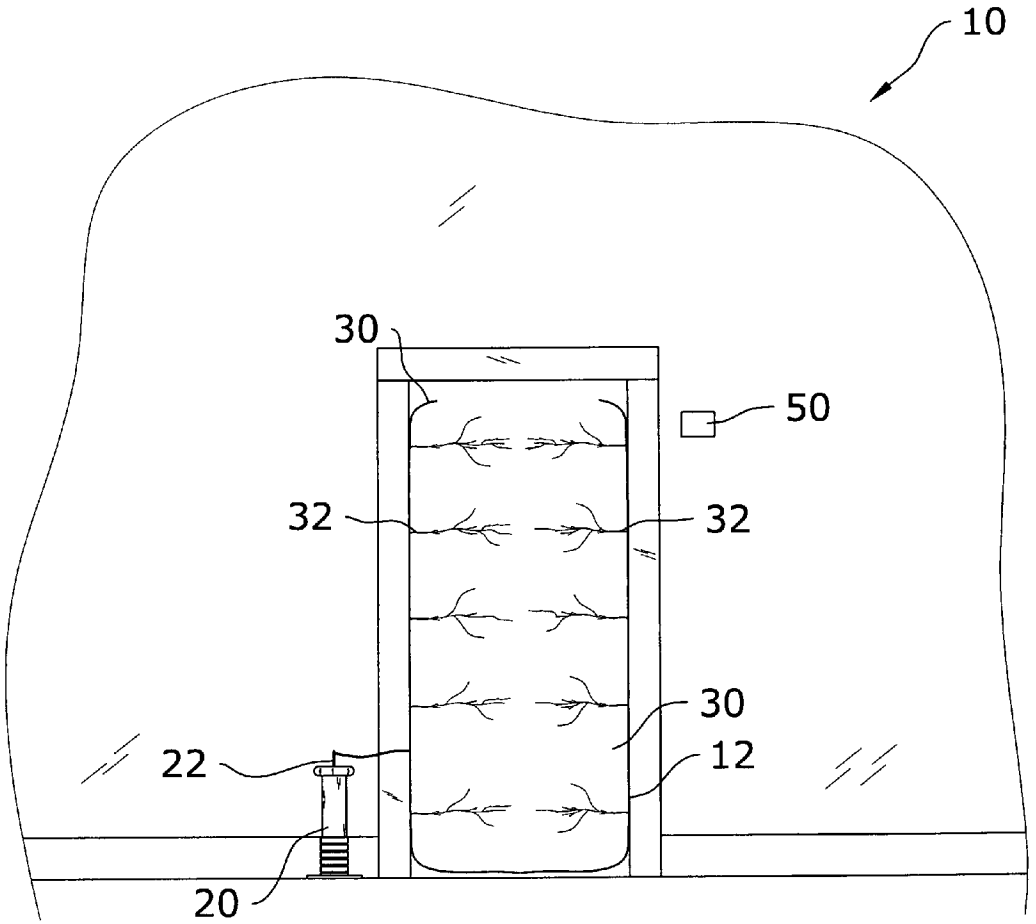
FIG. 3 is a front view of the present invention positioned within a doorway and activated creating an electrical visual effect that deters unauthorized entry.
Figure 4:
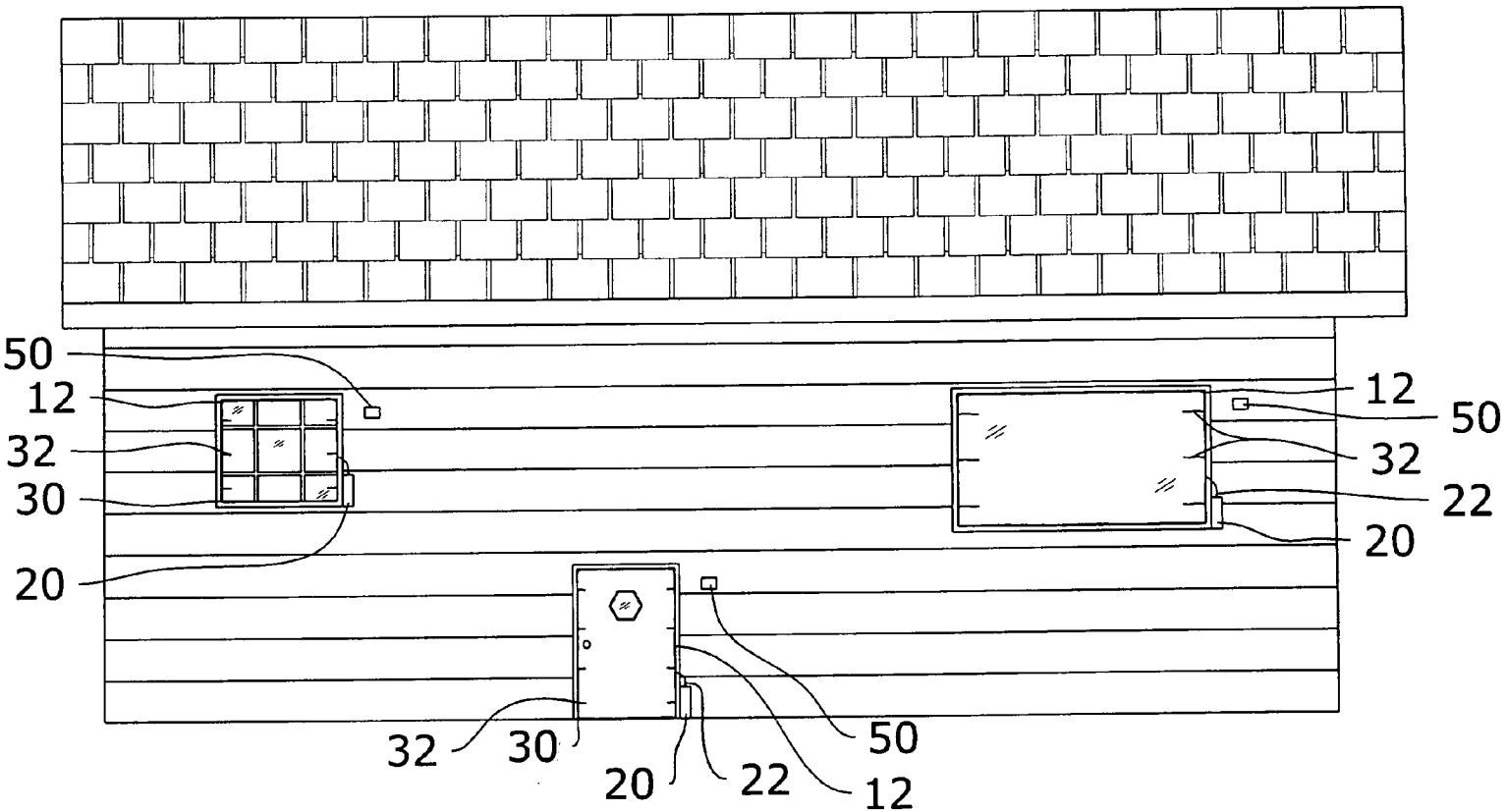
FIG. 4 is a front view of the present invention positioned within a doorway and windows of a building structure.
Figure 5:
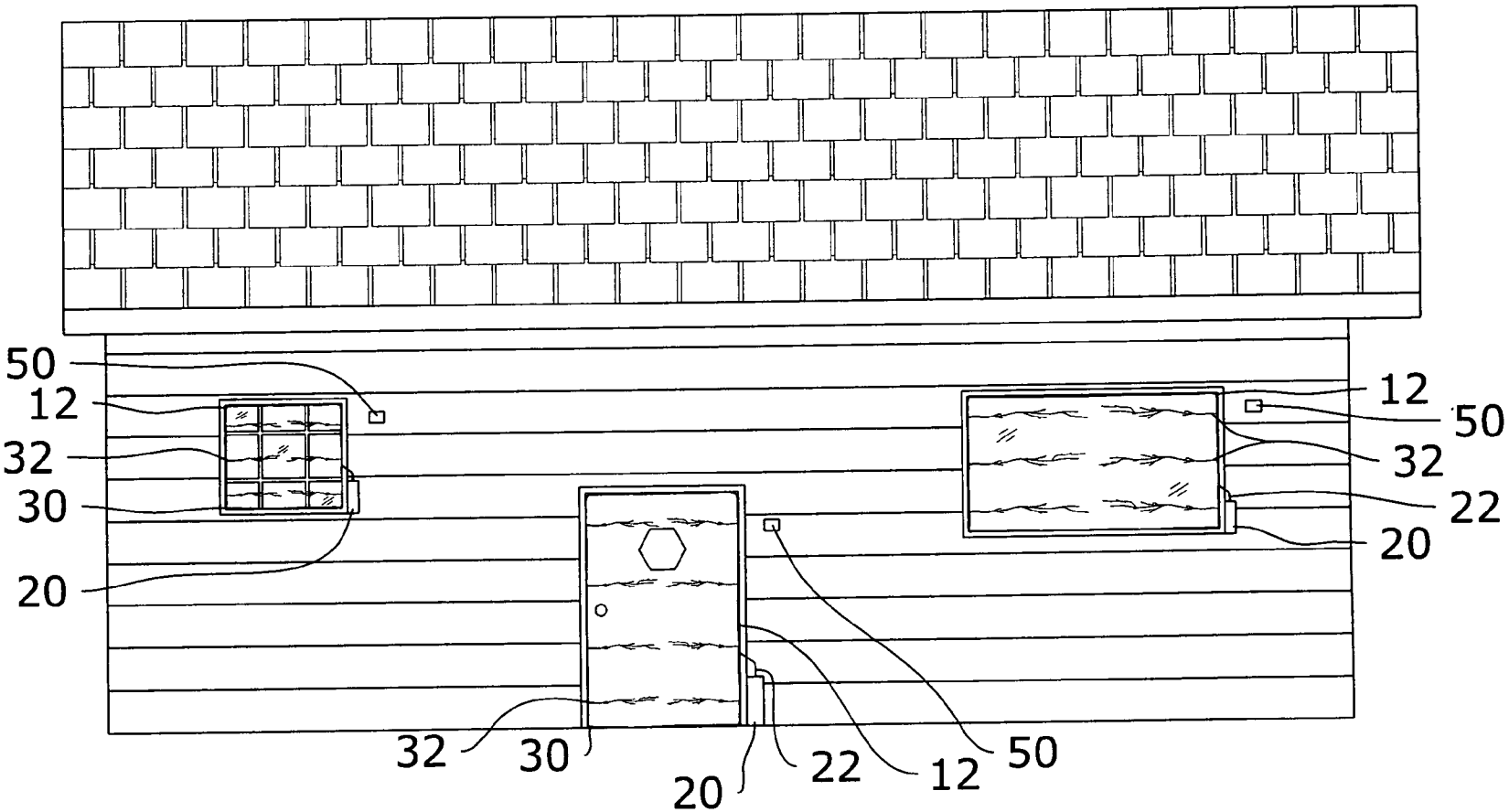
FIG. 5 is a front view of the present invention in operation as positioned within a doorway and windows of a building structure.
Figure 6:
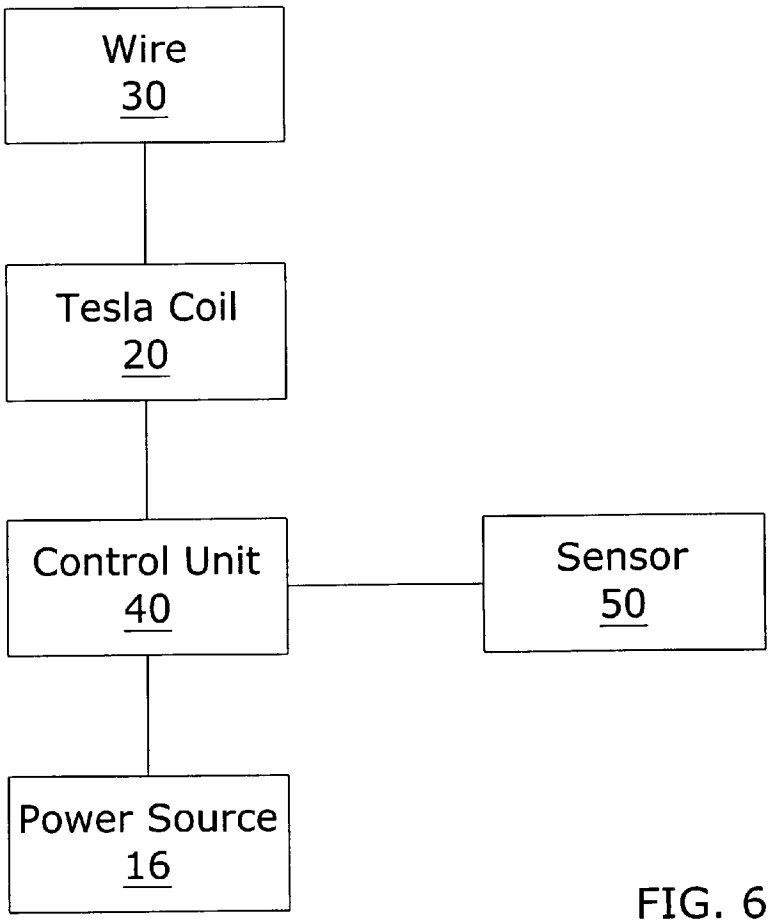
FIG. 6 is a block diagram illustrating the electrical components and connections of the present invention.

As shown in FIGS. 1 through 5 of the drawings, a plurality of charge dissipaters 32 electrically extend from the length of wire 30 for facilitating the discharge of electrical charge thereby creating an electrical visual effect similar to a tesla coil 20 for deterring entry through the opening 12. The plurality of charge dissipaters 32 preferably extend inwardly from the length of wire 30 as best illustrated in FIGS. 1 and 2 of the drawings. The charge dissipaters 32 preferably have a relatively shorter length with the distal end portion extended away from the wire 30.

D. Control Unit

A control unit 40 may be in communication with the tesla coil 20 for controlling the operation of the tesla coil 20. The control unit 40 may be comprised of any electrical device capable of controlling the electrical power and functions of the tesla coil 20 (e.g. computer). The control unit 40 is also electrically connected to a power source 16 (e.g. wall outlet) for receiving electrical power to be provided to the tesla coil 20. Alternatively, the tesla coil 20 could be electrically connected directly to the power source 16. In addition, a manual switch may be utilized to control the power to and operation of the tesla coil 20.

E. Sensor

A sensor 50 is preferably in communication with the control unit 40 as shown in FIGS. 1 through 6 of the drawings. The sensor 50 is for determining the presence of an individual, whereby detection by the sensor 50 of the presence of an individual causes the tesla coil 20 to be activated by the control unit 40 to deter the individual from attempting to enter through the opening 12. The sensor 50 may be comprised of various detection devices such as but not limited to a motion detecting device.

F. Installation of Invention

The tesla coil 20, control unit 40, length of wire 30 and at least one sensor 50 are provided to the location of installation (e.g. building, vehicle). The length of wire 30 is preferably attached about a perimeter of the opening 12 as illustrated in FIGS. 2 through 5 of the drawings. The length of wire 30 is further electrically connected to the tesla coil 20 and the tesla coil 20 is electrically connected to the control unit 40. Finally, the sensor 50 is either electrically connected to the control unit 40 or connected via a remote communication system (e.g. wireless).

G. Operation of Invention

In operation, the present invention may be operated manually or automatically. If the invention is operated manually, the user merely manually activates the tesla coil 20 to provide an electrical visual effect within the looped length of wire 30 that may be comprised of a closed loop or an open loop. If the invention is operated automatically, the sensor 50 determines the presence of an individual (e.g. via detected movement, body temperature, pressure) and communicates to the control unit 40 that an individual is near the opening 12 thereby activating the tesla coil 20. During automatic operation of the present invention, after the individual leaves the control unit 40 automatically turns off the tesla coil 20 either immediately or after a predetermined period of time.

When the tesla coil 20 is activated (either manually or automatically), an electrical charge is created within the tesla coil 20 that is transferred to the length of wire 30. The electrical charge is then transferred to the charge dissipaters 32 which dissipate the electrical charge into the air across the opening 12 thereby creating an electrical visual effect that deters entry by an unauthorized individual. The electrical charge dissipation is similar to that created by a tesla coil 20 and will not injure an individual or animals while simultaneously deterring entry through the opening 12.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A tesla coil security system, comprising:

a tesla coil;

a length of wire electrically connected to said tesla coil surrounding an opening to be protected;

a plurality of charge dissipaters electrically extending from said wire for facilitating the discharge of electrical charge thereby creating an electrical visual effect for deterring entry through said opening; and a control unit in communication with said tesla coil for controlling the operation of said tesla coil.

2. The tesla coil security system of claim 1, including a sensor in communication with said control unit for determining the presence of an individual, whereby detection by said sensor of said presence of an individual causes said tesla coil to be activated by said control unit.

3. The tesla coil security system of claim 2, wherein said sensor is comprised of a motion detecting device.

4. The tesla coil security system of claim 1, wherein said length of wire is formed into a closed loop and/or an open loop.

5. The tesla coil security system of claim 4, wherein said charge dissipaters extend inwardly from said length of wire.

6. The tesla coil security system of claim 4, wherein said length of wire is attached about a perimeter of said opening.

7. The tesla coil security system of claim 1, wherein said opening is comprised of a doorway.

8. The tesla coil security system of claim 1, wherein said opening is comprised of a window.

9. The tesla coil security system of claim 1, wherein said opening is comprised of a hallway or a passage of a building structure.

10. The tesla coil security system of claim 1, wherein said wire is electrically connected to an electrical connector of said tesla coil.

11. A tesla coil security system, comprising:

a tesla coil;

a length of wire electrically connected to said tesla coil surrounding an opening to be protected, wherein said length of wire is formed into a closed loop and/or an open loop and wherein said length of wire is attached about a perimeter of said opening;

a plurality of charge dissipaters electrically extending from said wire for facilitating the discharge of electrical charge thereby creating an electrical visual effect for deterring entry through said opening, wherein said charge dissipaters extend inwardly from said length of wire;

a control unit in communication with said tesla coil for controlling the operation of said tesla coil; and a sensor in communication with said control unit for determining the presence of an individual, whereby detection by said sensor of said presence of an individual causes said tesla coil to be activated by said control unit.

12. The tesla coil security system of claim 11, wherein said sensor is comprised of a motion detecting device.

13. The tesla coil security system of claim 11, wherein said opening is comprised of a doorway.

14. The tesla coil security system of claim 11, wherein said opening is comprised of a window.

15. The tesla coil security system of claim 11, wherein said opening is comprised of a hallway or a passage of a building structure.

16. The tesla coil security system of claim 11, wherein said wire is electrically connected to an electrical connector of said tesla coil.

17. A method of installing a security system, said method comprising the steps of:

providing a tesla coil;

providing a length of wire including a plurality of charge dissipaters electrically extending from said wire for facilitating discharge of electrical charge thereby creating an electrical visual effect for deterring entry through said opening, wherein said charge dissipaters extend inwardly from said length of wire;

attaching said length of wire about a perimeter of an opening to be protected;

electrically connecting said length of wire to said tesla coil;

providing a control unit;

connecting said control unit electrically to said tesla coil for controlling the operation of said tesla coil; and providing a sensor in communication with said control unit for determining the presence of an individual, whereby detection by said sensor of said presence of an individual causes said tesla coil to be activated by said control unit.

18. The method of installing a security system of claim 17, wherein said sensor is comprised of a motion detecting device.

19. The method of installing a security system of claim 17, wherein said opening is comprised of a doorway, a window, a hallway or a passage of a building structure.

20. The method of installing a security system of claim 17, wherein said opening is comprised of a doorway and/or a window of a vehicle.

* * * * *